US012414628B2

(12) United States Patent
Sagel

(10) Patent No.: US 12,414,628 B2
(45) Date of Patent: Sep. 16, 2025

(54) HEIGHT-ADJUSTABLE ROTARY FITTING FOR A CABINET COMPRISING A ROTATING SUPPORTING COLUMN

(71) Applicant: Vauth-Sagel Holding GmbH & Co. KG, Brakel (DE)

(72) Inventor: Peter Sagel, Paderborn (DE)

(73) Assignee: Vauth-Sagel Holding GmbH & Co. KG, Brakel (DE)

( * ) Notice: Subject to any disclaimer, the term of this patent is extended or adjusted under 35 U.S.C. 154(b) by 143 days.

(21) Appl. No.: 18/229,003

(22) Filed: Aug. 1, 2023

(65) Prior Publication Data

US 2025/0040698 A1 Feb. 6, 2025

(51) Int. Cl.
*A47B 49/00* (2006.01)

(52) U.S. Cl.
CPC ..... *A47B 49/006* (2013.01)

(58) Field of Classification Search
CPC ..... A47B 49/004; A47B 49/006
USPC ..... 312/238
See application file for complete search history.

(56) References Cited

U.S. PATENT DOCUMENTS 2,777,585 A * 1/1957 Jorgensen ..... A47B 49/006 211/144
4,181,037 A * 1/1980 Boon ..... A47B 49/006 312/238
4,688,686 A * 8/1987 Mitts ..... A47B 49/006 211/183
8,459,474 B2 6/2013 Sagel
9,103,362 B2 * 8/2015 Baro ..... A47B 49/006
9,936,805 B2 * 4/2018 McGregor ..... A47F 5/02
2022/0192372 A1 * 6/2022 Sagel ..... A47B 49/006

FOREIGN PATENT DOCUMENTS

CN 215226005 U * 12/2021
DE 202015107044 U1 * 5/2017
WO WO-2024105500 A1 * 5/2024

* cited by examiner

*Primary Examiner* — Andrew Roersma

(74) *Attorney, Agent, or Firm* — Thomas | Horstemeyer, LLP

(57) ABSTRACT

A rotary fitting for a cabinet with top and bottom walls comprises a rotating supporting column, a top and a bottom rotary mounts for the supporting column, and at least one shelf to be fixed to the supporting column. The supporting column has a main tube, a bottom element mounted to the main tube, and a height adjustment device for a height of the main tube above the bottom rotary mount. The height adjustment device comprises a screw and a nut screwed onto the screw. One of the screw and the nut is fixed to the bottom element, and the other is axially supported within the main tube and has a bevel gear. There is a guiding hole in the main tube adjacent to the bevel gear, through which the bevel gear can be engaged and rotated by a screwdriver crosstip.

18 Claims, 6 Drawing Sheets

HEIGHT-ADJUSTABLE ROTARY FITTING FOR A CABINET COMPRISING A ROTATING SUPPORTING COLUMN

FIELD OF THE INVENTION

The present invention generally relates to a height-adjustable rotary fitting for a cabinet. The rotary fitting comprises a rotating supporting column having a top end and a bottom end, a rotary top mount for the top end, a rotary bottom mount for the bottom end, and at least one shelf, often two shelves, to be fixed to the rotating supporting column for rotation with the rotating supporting column.

BACKGROUND OF THE INVENTION

U.S. Pat. No. 8,459,474 B2 discloses a rotary fitting for a corner cupboard comprises a lower and an upper mounting bracket; a supporting column having a main tube and being designed to be rotary mounted to the mounting brackets such that it rotates about its longitudinal axis; and at least two pie cut-shaped shelves to be supported by the supporting column fixed for rotation with the main tube. The supporting column includes a lower length adjusting assembly comprising a support element fixed in the main tube and comprising a recess; a screw element having a head fitting in the recess and a threaded shaft; a nut element arranged on the threaded shaft; and a lower end element fixed to the nut element and movable within the main tube; and an upper length adjusting assembly comprising a tube element partially arranged within the main tube; and a clamping element releasably clamping the tube element.

There still is a need of a height-adjustable rotary fitting for a cabinet comprising a rotating supporting column, which can be easily manufactured and installed in a cabinet, but nevertheless allows for a precise height-adjustment over a sufficiently wide range of heights.

SUMMARY OF THE INVENTION

The present invention relates to a rotary fitting for a cabinet having a body including a top wall and a bottom wall. The rotary fitting comprises a rotating supporting column having a longitudinal axis, a main tube extending along the longitudinal axis, a top end, a bottom element mounted to the main tube for rotation with the main tube about the longitudinal axis and having a bottom end, and a height adjustment device configured for adjusting a height of the main tube above the bottom end along the longitudinal axis. The rotary fitting further comprises a top rotary mount configured for being fixed to the top wall and for laterally and upwardly supporting the top end of the rotating supporting column in a rotating way, a bottom rotary mount configured for being fixed to the bottom wall and for laterally and downwardly supporting the bottom end of the bottom element of the rotating supporting column in a rotating way, and at least one shelf configured for being fixed to the main tube for rotation with the rotating supporting column about the longitudinal axis. The height adjustment device comprises a screw and a nut screwed onto the screw. One of the screw and the nut is fixed to the bottom element and wherein the other of the screw and the nut is axially supported along the longitudinal axis within the main tube and has a bevel gear. A guiding hole in the main tube is located adjacent to the bevel gear such that the bevel gear can be engaged and rotated about the longitudinal axis by a screwdriver crosstip inserted into the guiding hole.

The present invention also relates to a further rotary fitting for a cabinet having a body including a top wall and a bottom wall. The further rotary fitting also comprises a rotating supporting column having a longitudinal axis, a main tube extending along the longitudinal axis, a top end, a bottom element mounted to the main tube for rotation with the main tube about the longitudinal axis and having a bottom end, and a height adjustment device configured for adjusting a height of the main tube above the bottom end along the longitudinal axis. The further rotary fitting also further comprises a top rotary mount configured for being fixed to the top wall and for laterally and upwardly supporting the top end of the rotating supporting column in a rotating way, a bottom rotary mount configured for being fixed to the bottom wall and for laterally and downwardly supporting the bottom end of the bottom element of the rotating supporting column in a rotating way, and at least one shelf configured for being fixed to the main tube for rotation with the rotating supporting column about the longitudinal axis. The top end of the rotating supporting column of the further rotary fitting includes a sliding bushing inserted into the main tube. The top rotary mount has a base unit including a base plate with multiple mounting holes and a holding fixture, the holding fixture including a horizontal slot and a spring-loaded latch protruding into a lateral opening of the slot, and a stub unit including a mounting plate fitting into the slot behind the spring-loaded latch and a stub protruding downwards from the mounting plate. The stub has a circular supporting surface for laterally supporting the top end; and the stub, with its circular supporting surface, fits into the sliding bushing of the top end of the supporting column.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
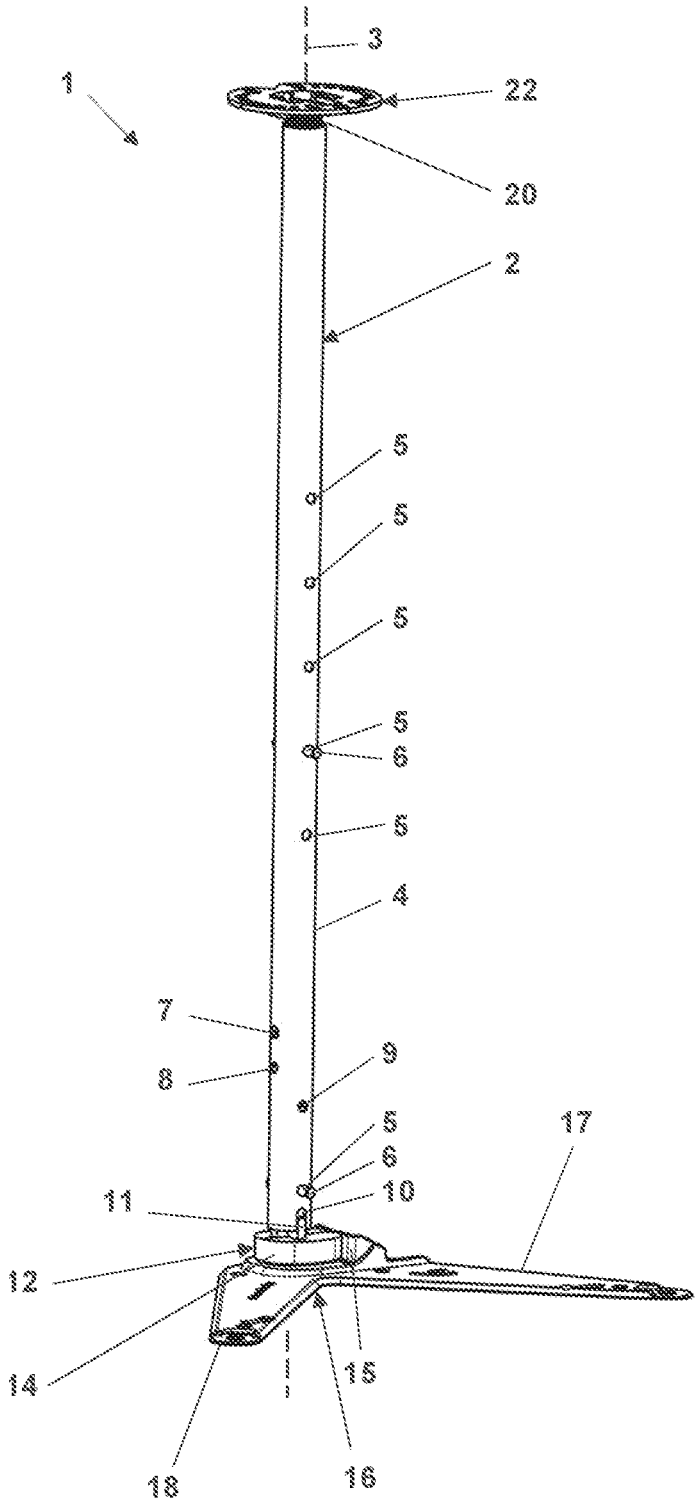
FIG. 1 is a perspective view of a rotary fitting for a cabinet, the rotary fitting being depicted without its shelves.

A rotary fitting according to the present invention is configured to support at least one shelf, often two shelves, in a rotating way within a cabinet. The cabinet may be a corner cabinet. In this case, the shelves may be so called pie-cut shelves, i.e. shelves of a circular basic shape from which pie-cuts, i. e. segments delimited by two orthogonal lines, have been removed or cut away. In the area of the pie-cut, a door of the corner cabinet may be fixed to the shelves for rotation with the shelves about a vertical axis. This vertical axis is a longitudinal axis of a rotating supporting column of the rotary fitting. The rotating supporting column comprises a main tube extending along the longitudinal axis, a top end, a bottom element mounted to the main tube for rotation with the main tube about the longitudinal axis and having a bottom end; and a height adjustment device for adjusting a height of the main tube above the bottom end along the longitudinal axis. A top rotary mount of the rotary fitting is to be fixed to the top wall of the body of the cabinet for laterally and upwardly supporting the top end of the rotating supporting column in a rotating way at the top wall. A bottom rotary mount of the rotary fitting is to be fixed to the bottom wall of the body of the cabinet for laterally and downwardly supporting the bottom end of the bottom element of the rotating supporting column in a rotating way at the bottom wall. The at least one shelf is to be fixed to the main tube for rotation with the rotating supporting column about the longitudinal axis.

In an embodiment a top rotary mount, the height adjustment device comprises a screw and a nut screwed onto the screw. Either the screw or the nut is fixed to the bottom element, and the other one of the nut and the screw is axially supported along the longitudinal axis within the main tube. Further, this other one of the nut and the screw has a bevel gear by means of which the other one of the nut and the screw may be easily rotated about the longitudinal axis in order to increase or decrease its distance to the screw or the nut fixed to the bottom element. Thus, the height of the main tube above the bottom element can be adjusted. A guiding hole in the main tube is located adjacent to the bevel gear such that the bevel gear can be engaged and rotated about the longitudinal axis by a screwdriver crosstip inserted into the guiding hole. Rotating the screwdriver crosstip about its crosstip axis by, for example, turning a screwdriver handle or operating an electric motor drive for the crosstip rotates the bevel gear and thus alters the height of the main tube above the bottom end of the rotary supporting column in a very easy way. Even larger differences in height may be covered by this height adjustment device effortlessly and particularly much easier and quicker than with prior art height adjustment device for rotary supporting columns.

In a more elaborate embodiment of the rotary fitting, a guiding wheel is arranged at a fixed axial distance to the bevel gear. The guiding wheel has a beveled rim which is facing the bevel gear. Thus, the engagement of the screwdriver crosstip inserted into the guiding hole in the main tube is stabilized by the beveled rim of the guiding wheel facing the beveled gear across the screwdriver crosstip.

The guiding wheel may be mounted to the other one of the nut and the screw that has the bevel gear. In one embodiment, the guiding wheel is mounted to the other one of the nut and the screw in such a way that it is free-wheeling about the longitudinal axis. This allows for a particular easy rotation of the screwdriver crosstip inserted in the guiding hole and engaging the bevel gear in height-adjustment. In another embodiment, the guiding wheel is mounted to the other one of the nut and the screw in such a way that it is fixed for rotation with the other one of the nut and the screw about the longitudinal axis.

In one embodiment of the rotary fitting, the bevel gear is pointing to the bottom end of this rotating supporting column. Then, the non-beveled upper end of the other one of the nut and the screw may be used for axially supporting the other one of the nut and the screw at the main tube.

The other of the nut and the screw may be the screw. In this case, the bevel gear may be provided at a head of the screw, and it may be provided at the underside of the head of the screw.

In any case, the other one of the nut and the screw can be axially supported at an axial support element which is, at least axially, fixed within the main tube. For example, the support element may be riveted or bolted to the main tube.

The bevel gear may have a pitch cone in a range between 90° and 150°. More particularly, the bevel gear may have a pitch cone and a shape matching an ANSI type I or an ANSI type IA screwdriver crosstip. More particularly, the bevel gear may match such a screwdriver crosstip of size 2.

An ANSI type I screwdriver crosstip is also known as a Phillips screwdriver crosstip. An ANSI type IA screwdriver crosstip is also known as a Pozidriv screwdriver crosstip. Thus, the size 2 screwdriver crosstip may be a PH 2 or PZ 2 screwdriver crosstip. Correspondingly, the guiding hole in the main tube may be a circular hole having a diameter in a typical range between 3 mm and 8 mm.

In one embodiment, the bottom end of the rotating supporting column has a cross hole extending orthogonal to the longitudinal axis and elongated along the longitudinal axis. A cross pin extends through fitted holes in the main tube and, with axial play along the longitudinal axis, through the cross hole. Pin ends of the cross pin protruding from the main tube may fit into recesses in a bottom side of the at least one shelf. Thus, the at least one shelf may be axially supported at and fixed for rotation with the rotating supporting column via this cross pin.

In an embodiment, the bottom end of the rotating supporting column has a heart-shaped cam, and the bottom rotary mount of the rotary fitting has a spring-loaded cam follower releasably holding the rotating supporting column in a defined rotary position. This defined rotary position typically corresponds to a closed state of a corner cabinet in which a door fixed to the shelves of the rotary fitting closes an opening of the corner cabinet.

In an embodiment, the bottom rotary mount has a pair of legs comprising mounting holes and arranged in a V-configuration. The mounting holes in the legs allow for easily fixing the bottom rotary mount to the bottom wall of the body of the cabinet.

In an embodiment of the rotary fitting, the top rotary mount has a base unit including a base plate with multiple mounting holes and a holding fixture. The holding fixture includes a horizontal slot and a spring-loaded latch protruding into a lateral opening of the slot. The top mount further includes a mounting plate fitting into the slot behind the spring-loaded latch and a stub protruding downwards from the mounting plate. The stub has a circular supporting surface for laterally supporting the top end of the rotating supporting column. The stub, with a circular supporting surface may fit into the upper end of the supporting column.

Additionally or alternatively, the stub may comprise multiple circular grooves in its circular supporting surface. These circular grooves may be used to snap in a safety clip having a laterally open snap-in ring. More particular, the safety clip may be snapped into that one of the multiple circular grooves directly above the top end of the supporting column such as to avoid an undesired upward movement of the supporting column with respect to the top rotary mount.

The safety clip may be used as a transport safety device, if cabinet with a mounted rotary fitting is to be transported.

Further, the safety clip may have a laterally open cylindrical outer guiding barrel protruding downward from the snap-in ring to more securely fix the safety clip to the rotary fitting.

Once the cabinet has reached its final destination, the safety clip may be removed, but it may also be left where it is as it does not affect the use of the rotary fitting. However, it may have to be removed or snapped into another one of the multiple circular grooves for an unhindered height adjustment of the rotating supporting column by means of its height adjustment device.

For easy handling, the safety clip may have a pair of handles laterally projecting from the safety clip such that lateral openings of the snap-in ring and the guiding barrel are widened upon compressing the pair of handles.

In one embodiment, the upper end of the rotating supporting column includes a sliding bushing inserted into the main tube. Then, the stub of the top rotary mount fits into this sliding bushing.

Figure 2:
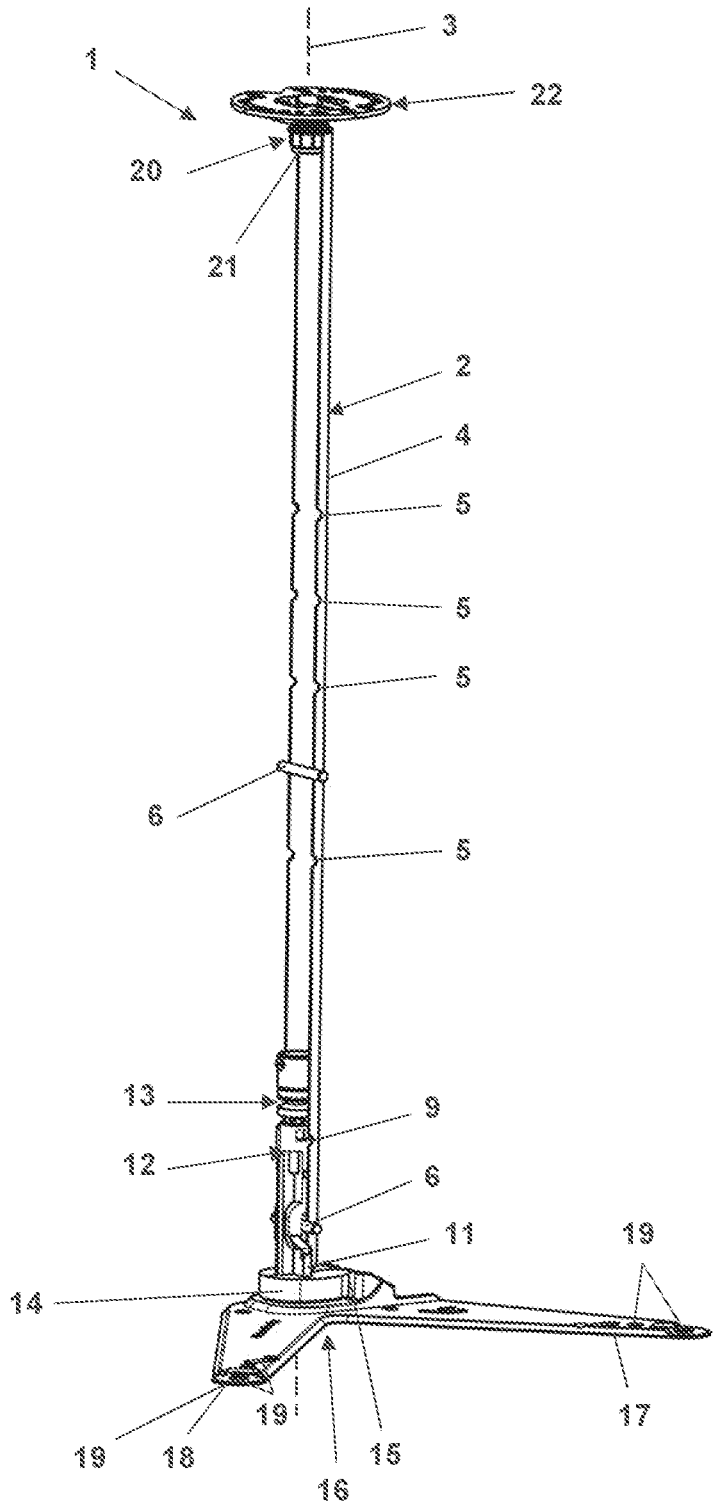
FIG. 2 is a perspective view of the rotary fitting of FIG. 1, in which a halve of a main tube of a rotating supporting column of the rotary fitting is cut away along a longitudinal axis of the rotating supporting column.

Now referring in greater detail to the drawings, FIGS. 1 and 2 show a height-adjustable rotary fitting 1 for a cabinet except of its shelves and except of the cabinet which are not depicted here. The rotary fitting 1 comprises a supporting column 2. The supporting column 2 has a longitudinal axis 3 oriented vertically, and a main tube 4. A halve of the main tube 4 is cut away in FIG. 2 to show the interior of the main tube 4. The main tube 4 is typically made of metal. For example, the main tube 4 is made of a metal tube section and may be coated with white lacquer or plated with chrome. The main tube comprises a number of cross holes 5 each configured to receive a cross pin 6 for axially supporting and fixing one of the shelves to the supporting column 2. Further, the main tube comprises a mounting hole 7, a guiding hole 8 and a further hole 9 whose functions will be explained with reference to FIG. 3 below. Further, the main tube comprises downwardly open slots 10 into which guiding ribs 11 of a bottom element 12 of the supporting column 2 engage in an axially sliding way. The guiding ribs 11 in the guiding slots 10 fix the bottom element 12 for rotation with the supporting column 2 about the longitudinal axis 3. The bottom element 12 further comprises a height adjustment device 13 only visible in FIG. 2, and a heart-shaped cam 14. The heart-shaped cam 14 cooperates with a spring-loaded cam follower 15 of a bottom rotary mount 16 for a bottom end of the supporting column 2. The bottom rotary mount 16 has a pair of legs 17, 18 comprising a plurality of mounting holes 19 and arranged in a V-configuration. The bottom rotary mount is configured to be fixed to a bottom wall of a body of the cabinet not depicted here.

Further, the supporting column 2 has a top end 20. The top end 20 includes a sliding bushing or sleeve 21 inserted into the main tube 4. A top rotary mount 22 of the rotary fitting 1 is configured for supporting the top end 20 upwardly and laterally in a rotating way about the longitudinal axis 3.

Figure 3:
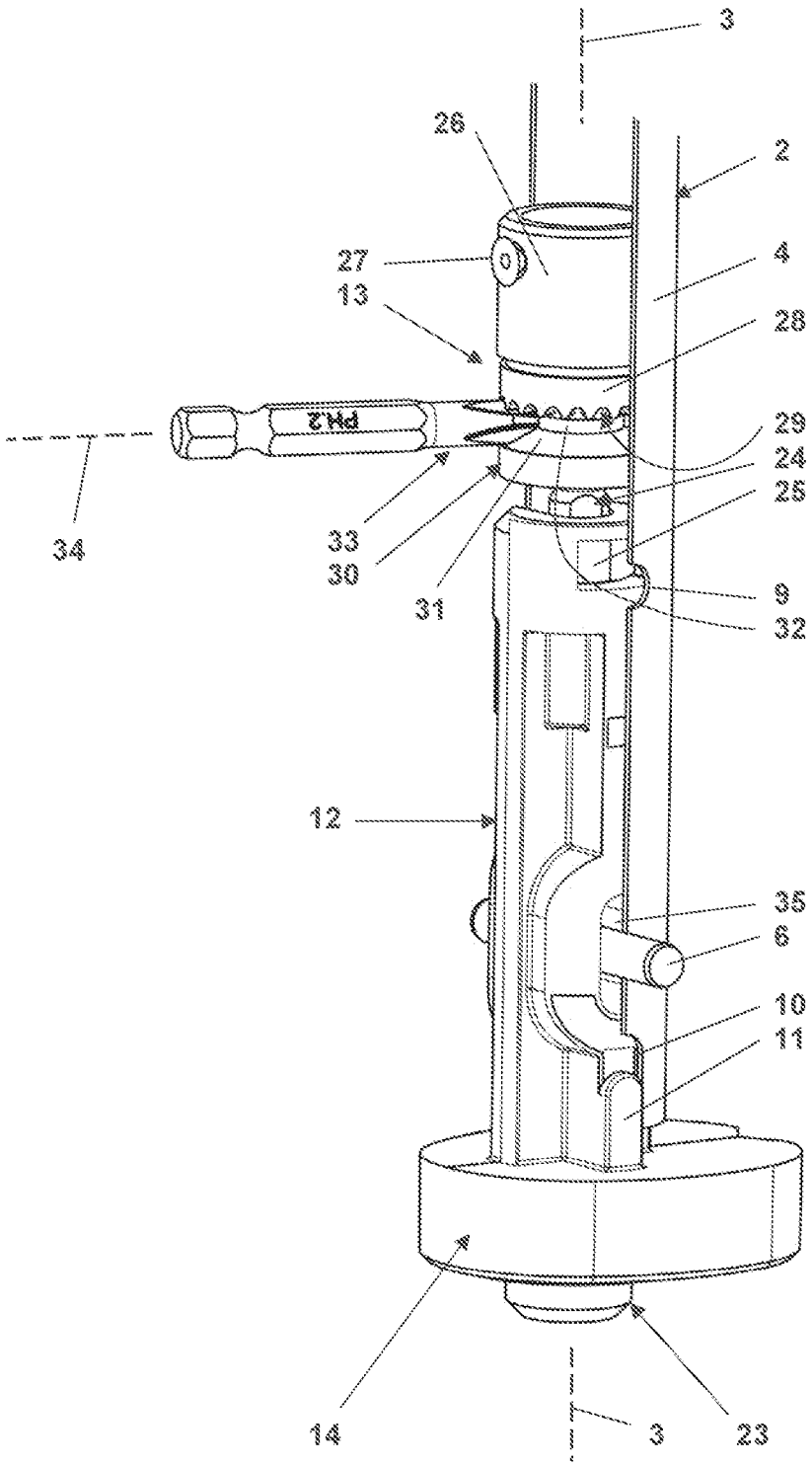
FIG. 3 shows a bottom end of the rotating supporting column depicted in FIG. 1.

FIG. 3 separately shows a lower area of the supporting column 2, once again with a halve of the main tube 4 being cut away to show the bottom element 12 and the height adjustment device 13 arranged within the main tube 4.

As FIG. 3 does not depict the bottom rotary mount 16, the bottom end 23 laterally and downwardly supported by the bottom rotary mount 16 is visible. The height adjustment device 13 is configured and provided for adjusting a height of the main tube 4 above the bottom end 23 along the longitudinal axis 3. The height adjustment device comprises a screw 24 and a nut 25 screwed on the screw 24. In the present embodiment, the nut is form fitted in a recess of the bottom element 12 and fixed to the bottom element 12, and the screw 24 is axially supported along the longitudinal axis 3 within the main tube 4 at an axial support element 26. The axial support element 26 is fixed within the main tube 4 by rivets 27 extending through the mounting holes 7 in the main tube 4. The support element axially supports an upper side of a head 28 of the screw 24. At its lower side, the head 28 is provided with a bevel gear 29. Thus, the bevel gear 29 is pointing downwards and towards the bottom end 23. A guiding wheel 30 is arranged at a fixed axial distance to the bevel gear 29 and has a beveled rim 31 facing the bevel gear 29. The guiding wheel and the screw 24 are one piece, or the guiding wheel is mounted to the screw 24 and fixed for rotation with the screw 24, here. In another embodiment, the guiding wheel is freewheeling with respect to the screw 24 about the longitudinal axis 3. A channel 32 formed between the bevel gear 29 and the beveled rim 31 has an axial cross section adapted to a screwdriver crosstip 33 which is inserted into the guiding hole 8. Turning the screwdriver crosstip 33 about its crosstip axis 34 results in a rotation of the bevel gear 29 at the head 28 and thus of the entire screw 24 about the longitudinal axis 3. As a consequence, the screw 24 is screwed out of or further into the nut 25. This raises or lowers the main tube 4 above or down to the bottom end 23. In the present case, the screwdriver crosstip 33 is a "PH2", i.e. a size 2 ANSI type I screwdriver crosstip. In axial direction, the screwdriver crosstip 33 is held in engagement with the bevel gear 29 by the beveled rim 31 of the guiding wheel 30. In circumferential direction around the longitudinal axis 3, the screwdriver crosstip 33 is supported by the rim of the guiding hole 8 in the main tube 4. Besides the guiding ribs 11 engaging into the guiding slots 10, the bottom element 12 is fixed for rotation with the main tube 4 but axially moveable along the longitudinal axis 3 with respect to the main tube 4 by means of the lower cross pin 6. The lower cross pin which axially supports and fixes one of the shelves to the supporting column 2 is fitted into one pair of the cross holes 5 in the main tube 4 and extends through an axially elongated cross hole 35 in the bottom element 12 with axial play along the longitudinal axis 3. The further hole 9 either provides a view on the nut 25 or on the bottom element 12 and thus indicates the height of the main tube 4 above the bottom end 23 when the guiding ribs 11 engaging the guiding slots 10 are not visible but covered by a shelf supported on the lower cross pin 6. The further hole 9 may also be used to axially fix a shelve to the supporting column 2 using a fixing element engaging with the further hole 9. The screwdriver crosstip 33 may, for example, be turned manually by a screwdriver handle or by a motor screwdriver. Despite the fact that a fine adjustment of the height of the main tube 4 above the bottom end 23 is possible with the screwdriver crosstip 33, it is also possible to easily cover larger differences in height by means of quickly turning the screwdriver crosstip 33 about the crosstip axis 34.

Figure 4:
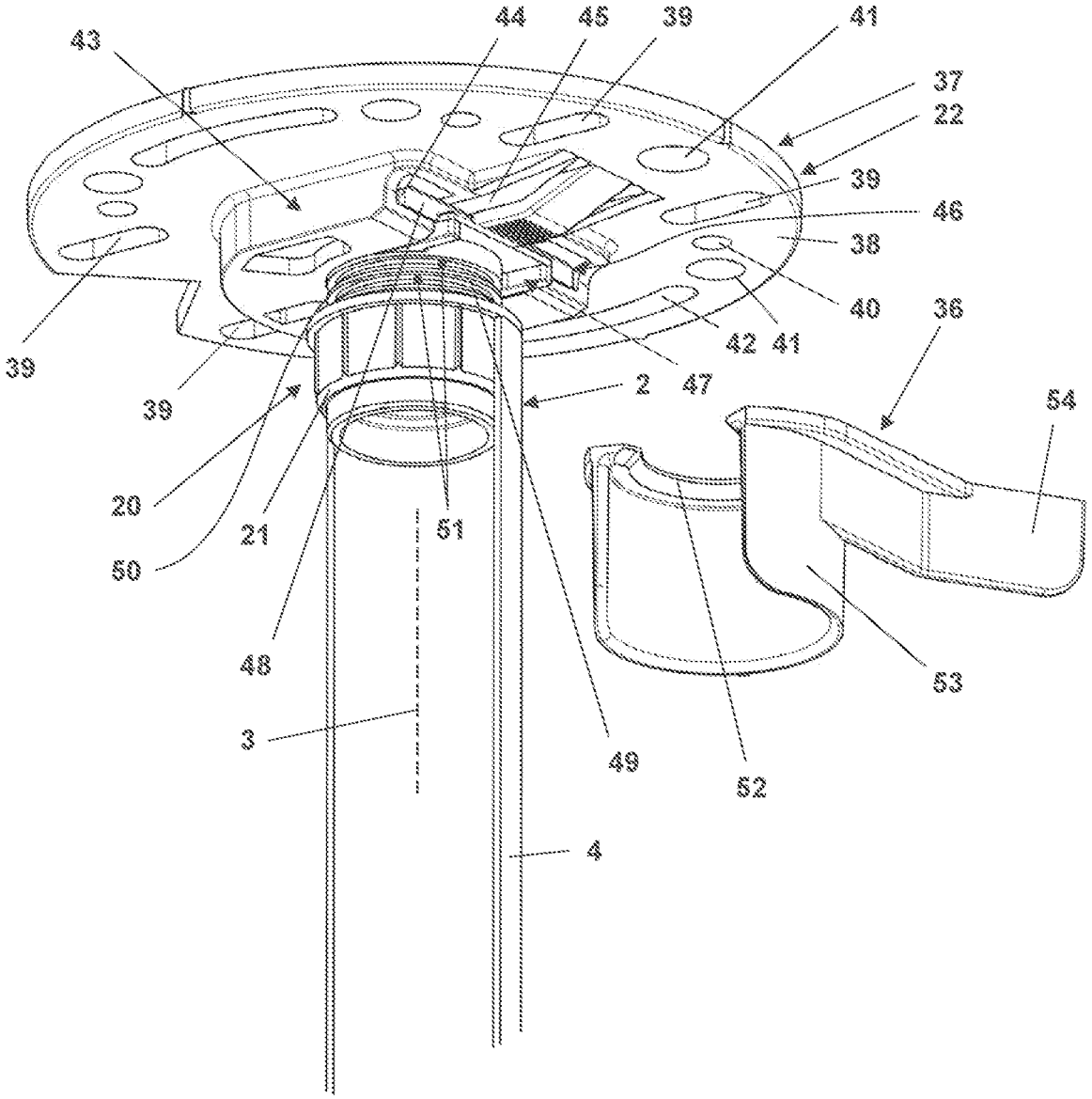
FIG. 4 shows a top end of the rotating supporting column depicted in FIG. 2 and an additional safety clip, the viewing direction being different to that one of FIG. 2.

FIG. 4 shows the top end 20 of the supporting column 2 with the sliding bushing 21 inserted into the main tube 4, and the top rotary mount 22 including a safety clip 36 in a perspective view showing the lower side of the top rotary mount 22. The top rotary mount 22 has a base plate unit 37 comprises a base plate 38 provided with multiple mounting holes 39 to 42. The mounting holes 39 to 42 are provided for fixing the base plate 38 to a top wall of a body of the cabinet not depicted. Further, the base unit 37 comprises a holding fixture 43. The holding fixture 43 includes a horizontal slot 44 and a spring-loaded latch 45 protruding into a lateral opening 46 of the slot 44. In addition to the base unit 37, the top rotary mount 22 has a stub unit 47. The stub unit 47 includes a mounting plate 48 fitting into the slot 44 behind the spring-loaded latch 45, and a stub 49 having a circular supporting surface 50 for engaging into the sliding bushing 21 for laterally supporting the top end 20. The stub 49 comprises a plurality of circular grooves 51 in its circular supporting surface 50. The safety clip 36 has an open snap-in ring 52 configured to snap into one of the circular grooves 51. Further, the safety clip 36 has a laterally open cylindrical outer guiding barrel 53 protruding downwards from the snap-in ring. The guiding barrel 53 is configured for receiving the top end 20 of the supporting column 2. For attaching or detaching the safety clip 36 to or from the stub unit 47 and the top end 20, the safety clip had as a pair of handles 54 laterally projecting such that lateral openings of the snap in ring 52 and the guiding barrel 54 are widened upon compressing the pair of handles 54. The safety clip 36 may be used as a transport safety device holding-down the supporting column 2 of the rotary fitting 1 mounted in a cabinet such that its bottom end 23 is held within the bottom rotary mount 16. Thus, it is avoided that the supporting column 2 gets loose from both rotary mounts 16 and 22. Once the cabinet has reached its final destination, the safety clip 36 may be removed for the fine adjustment of the height of the supporting column 2, but it may be replaced afterwards as the safety clip 36 does not affect the actual use of the rotary fitting 1.

Figure 5:
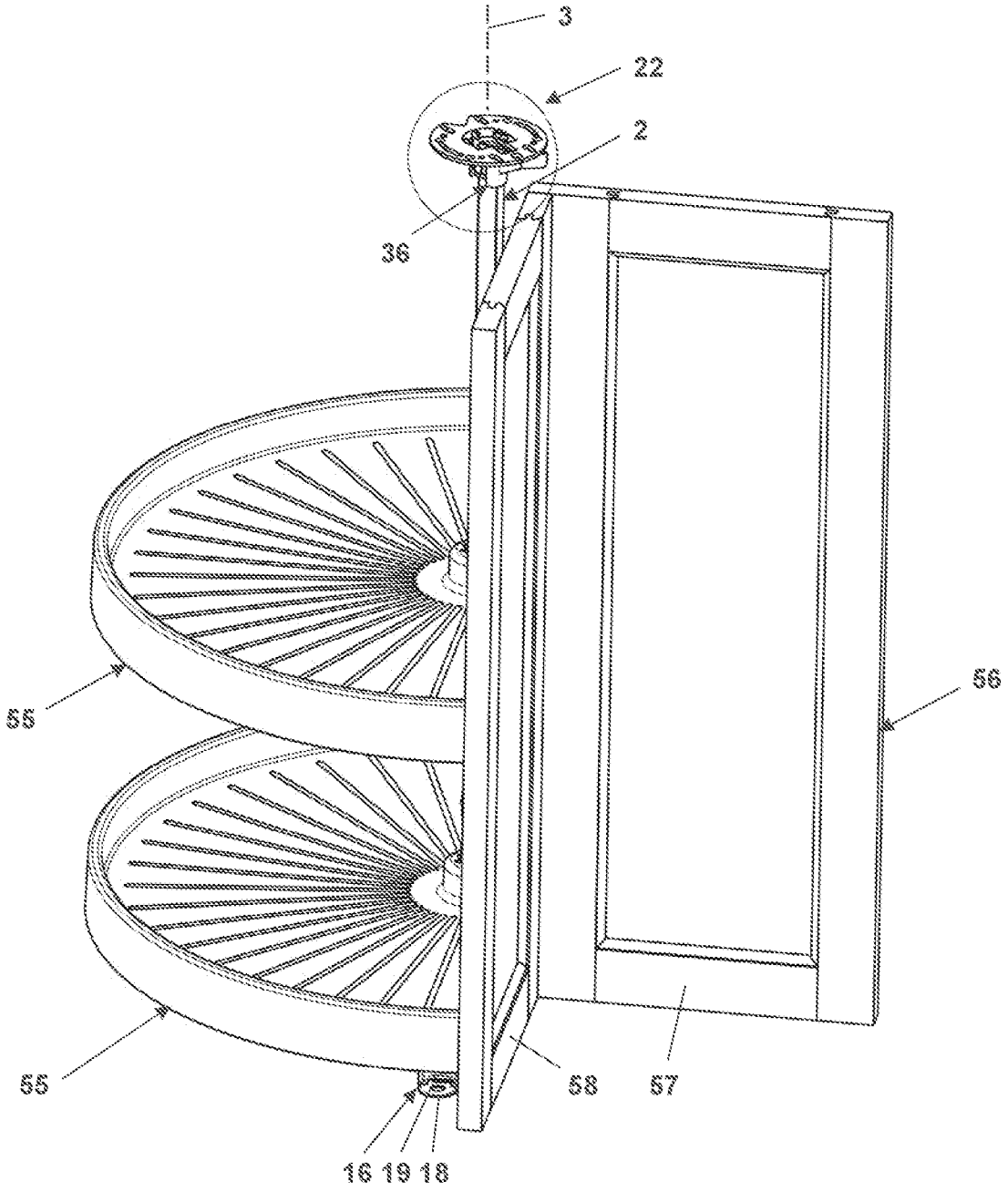
FIG. 5 shows the full rotary fitting according to FIG. 1 with two shelves plus an additional cabinet door mounted to the pie-cut shelves and with the safety clip of FIG. 4 mounted to the top end of its rotating supporting column.
Figure 6:
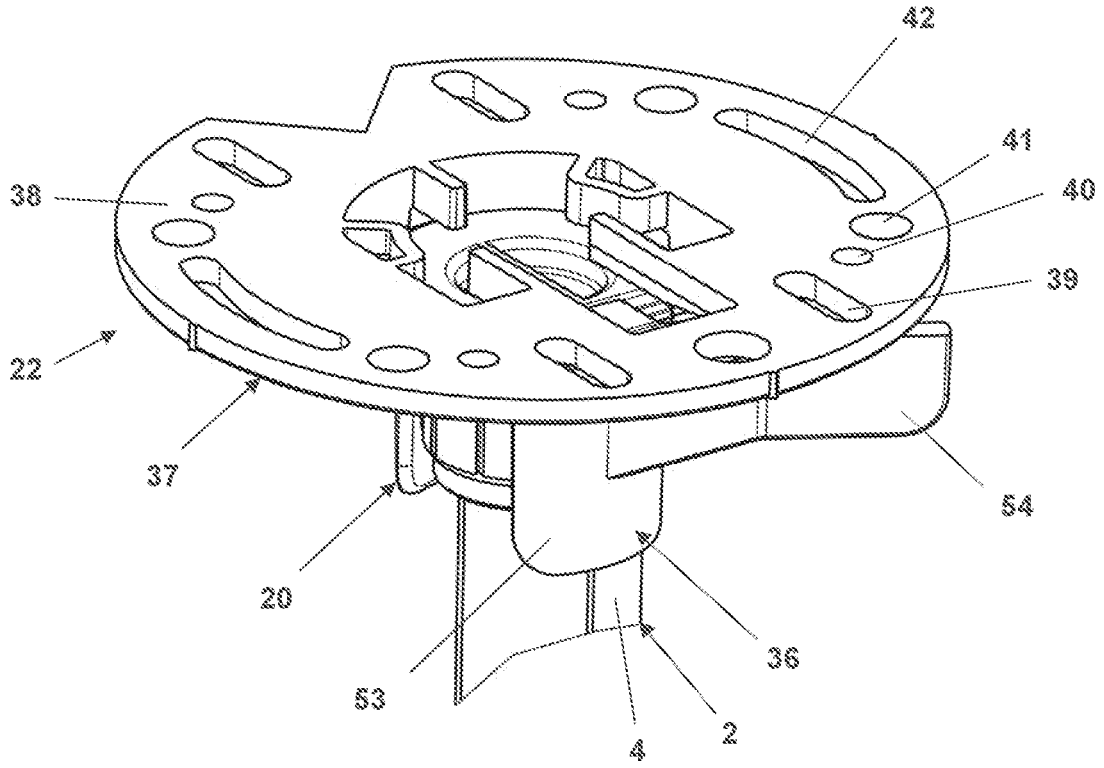
FIG. 6 shows a detail of the rotary fitting according to FIG. 5 at an enlarged scale, the detail including the safety clip and a top rotary mount.

FIG. 5 and its enlarged detail according to FIG. 6 show the safety clip 36 attached to the upper end 20 of the supporting column 2. Further, FIG. 5 shows two shelves 55 supported at and fixed for rotation with the supporting column 2. The shelves 55 are of pie-cut shape and in their pie-cuts a door 56 of the cabinet is arranged and fixed to the shelves 55 or the supporting column 2 for rotation with the supporting column 2 about the longitudinal axis 3. The door 56 consists of two door elements 57 and 58 arranged at a right angle. For opening the cabinet not further depicted here, the door 56 rotates into the body of the cabinet, and the shelves 55, at the same time, rotate out of the body of the cabinet about the vertically oriented longitudinal axis 3.

Many variations and modifications may be made to the preferred embodiments of the invention without departing substantially from the spirit and principles of the invention. All such modifications and variations are intended to be included herein within the scope of the present invention, as defined by the following claims.

I claim:

1. A rotary fitting for a cabinet having a body including a top wall and a bottom wall, the rotary fitting comprising:

a rotating supporting column having a longitudinal axis, a main tube extending along the longitudinal axis, a top end, a bottom element mounted to the main tube for rotation with the main tube about the longitudinal axis and having a bottom end, and a height adjustment device configured for adjusting a height of the main tube above the bottom end along the longitudinal axis, a top rotary mount configured for being fixed to the top wall and for laterally and upwardly supporting the top end of the rotating supporting column in a rotating way, a bottom rotary mount configured for being fixed to the bottom wall and for laterally and downwardly supporting the bottom end of the bottom element of the rotating supporting column in a rotating way, and at least one shelf configured for being fixed to the main tube for rotation with the rotating supporting column about the longitudinal axis, wherein the height adjustment device comprises a screw and a nut screwed onto the screw, wherein one of the screw and the nut is fixed to the bottom element and wherein the other of the screw and the nut is axially supported along the longitudinal axis within the main tube and has a bevel gear, wherein a guiding hole in the main tube is located adjacent to the bevel gear such that the bevel gear can be engaged and rotated about the longitudinal axis by a screwdriver crosstip inserted into the guiding hole; and wherein a guiding wheel is arranged at a fixed axial distance to the bevel gear, wherein a beveled rim of the guiding wheel is facing the bevel gear.

2. The rotary fitting of claim 1, wherein the guiding wheel is mounted to the other of the screw and the nut.

3. The rotary fitting of claim 2, wherein the guiding wheel is free-wheeling about the longitudinal axis.

4. The rotary fitting of claim 1, wherein the bevel gear is pointing to the bottom end.

5. The rotary fitting of claim 1, wherein the other of the screw and the nut is the screw, wherein the bevel gear is provided at a head of the screw.

6. The rotary fitting of claim 1, wherein the other of the screw and the nut is axially supported at an axial support element which is, at least axially, fixed within the main tube.

7. The rotary fitting of claim 1, wherein the bevel gear has a pitch cone in a range between 90° and 150°.

8. The rotary fitting of claim 1, wherein the bevel gear has a shape matching a size 2 ANSI type I or IA screwdriver crosstip.

9. The rotary fitting of claim 1, wherein the guiding hole is a circular hole having a diameter in a range between 3 mm and 8 mm.

10. The rotary fitting of claim 1, wherein the bottom element has a cross hole extending orthogonal to the longitudinal axis and elongated along the longitudinal axis, wherein a cross pin extends through fitted holes in the main tube and with axial play along the longitudinal axis through the cross hole, and wherein pin ends of the cross pin protruding from the main tube fit into recesses in a bottom side of the at least one shelf.

11. The rotary fitting of claim 1, wherein the bottom end has a heart-shaped cam, and the bottom rotary mount has a spring-loaded cam follower.

12. The rotary fitting of claim 1, wherein the bottom rotary mount has a pair of legs comprising mounting holes and arranged in a V-configuration.

13. The rotary fitting of claim 1, wherein the top rotary mount has:

a base unit including a base plate with multiple mounting holes and a holding fixture, the holding fixture including a horizontal slot and a spring-loaded latch protruding into a lateral opening of the slot, and a stub unit including a mounting plate fitting into the slot behind the spring-loaded latch and a stub protruding downwards from the mounting plate, the stub having a circular supporting surface for laterally supporting the top end.

14. The rotary fitting of claim 13, wherein the stub, with said circular supporting surface, fits into the top end of the supporting column, and wherein the top end of the rotating supporting column includes a sliding bushing inserted into the main tube.

15. A rotary fitting for a cabinet having a body including a top wall and a bottom wall, the rotary fitting comprising:

a rotating supporting column having a longitudinal axis, a main tube extending along the longitudinal axis, a top end, a bottom element mounted to the main tube for rotation with the main tube about the longitudinal axis and having a bottom end, and a height adjustment device configured for adjusting a height of the main tube above the bottom end along the longitudinal axis, a top rotary mount configured for being fixed to the top wall and for laterally and upwardly supporting the top end of the rotating supporting column in a rotating way, a bottom rotary mount configured for being fixed to the bottom wall and for laterally and downwardly supporting the bottom end of the bottom element of the rotating supporting column in a rotating way, and at least one shelf configured for being fixed to the main tube for rotation with the rotating supporting column about the longitudinal axis, wherein the height adjustment device comprises a screw and a nut screwed onto the screw, wherein one of the screw and the nut is fixed to the bottom element and wherein the other of the screw and the nut is axially supported along the longitudinal axis within the main tube and has a bevel gear, wherein a guiding hole in the main tube is located adjacent to the bevel gear such that the bevel gear can be engaged and rotated about the longitudinal axis by a screwdriver crosstip inserted into the guiding hole, wherein the top rotary mount has:

a base unit including a base plate with multiple mounting holes and a holding fixture, the holding fixture including a horizontal slot and a spring-loaded latch protruding into a lateral opening of the slot, and a stub unit including a mounting plate fitting into the slot behind the spring-loaded latch and a stub protruding downwards from the mounting plate, the stub having a circular supporting surface for laterally supporting the top end, and wherein:

the stub comprises multiple circular grooves in said circular supporting surface, and wherein the top rotary mount includes a safety clip having an open snap-in ring configured to snap into one of the multiple circular grooves.

16. The rotary fitting of claim 15, wherein the safety clip has a laterally open cylindrical outer guiding barrel protruding downwards from the snap-in ring, and wherein the safety clip has a pair of handles laterally projecting such that lateral openings of the snap-in ring and the guiding barrel are widened upon compressing the pair of handles.

17. A rotary fitting for a cabinet having a body including a top wall and a bottom wall, the rotary fitting comprising:

a rotating supporting column having a longitudinal axis, a main tube extending along the longitudinal axis, a top end, a bottom element mounted to the main tube for rotation with the main tube about the longitudinal axis and having a bottom end, and a height adjustment device configured for adjusting a height of the main tube above the bottom end along the longitudinal axis, a top rotary mount configured for being fixed to the top wall and for laterally and upwardly supporting the top end of the rotating supporting column in a rotating way, a bottom rotary mount configured for being fixed to the bottom wall and for laterally and downwardly supporting the bottom end of the bottom element of the rotating supporting column in a rotating way, and at least one shelf configured for being fixed to the main tube for rotation with the rotating supporting column about the longitudinal axis, wherein the top end of the rotating supporting column includes a sliding bushing inserted into the main tube, and wherein the top rotary mount has:

a base unit including a base plate with multiple mounting holes and a holding fixture, the holding fixture including a horizontal slot and a spring-loaded latch protruding into a lateral opening of the slot, and a stub unit including a mounting plate fitting into the slot behind the spring-loaded latch and a stub protruding downwards from the mounting plate, the stub having a circular supporting surface for laterally supporting the top end, wherein the stub, with said circular supporting surface, fits into the sliding bushing of the top end of the supporting column, and wherein the stub comprises multiple circular grooves in said circular supporting surface, and wherein the top rotary mount includes a safety clip having an open snap-in ring configured to snap into one of the multiple circular grooves.

18. The rotary fitting of claim 17, wherein the safety clip has a laterally open cylindrical outer guiding barrel protruding downwards from the snap-in ring, and wherein the safety clip has a pair of handles laterally projecting such that lateral openings of the snap-in ring and the guiding barrel are widened upon compressing the pair of handles.

* * * * *